US010022846B2

(12) United States Patent
Wang

(10) Patent No.: US 10,022,846 B2
(45) Date of Patent: Jul. 17, 2018

(54) SCREWDRIVER

(71) Applicant: HANGZHOU GREAT STAR TOOLS CO., LTD, Hangzhou (CN)

(72) Inventor: Weiyi Wang, Hangzhou (CN)

(73) Assignees: HANGZHOU GREAT STAR TOOLS CO., LTD., Hangzhou (CN); HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 335 days.

(21) Appl. No.: 14/369,821

(22) PCT Filed: May 27, 2013

(86) PCT No.: PCT/CN2013/076250
§ 371 (c)(1),
(2) Date: Jun. 30, 2014

(87) PCT Pub. No.: WO2014/190466
PCT Pub. Date: Dec. 4, 2014

(65) Prior Publication Data

US 2015/0336245 A1 Nov. 26, 2015

(51) Int. Cl.
*B25B 17/00* (2006.01)
*B25B 17/02* (2006.01)
(Continued)

(52) U.S. Cl.
CPC ..... *B25B 17/00* (2013.01); *B25B 15/02* (2013.01); *B25B 15/04* (2013.01); *B25B 17/02* (2013.01)

(58) Field of Classification Search
CPC ..... B25B 15/04; B25B 17/02; B25B 17/00; B25B 15/02
(Continued)

(56) References Cited

U.S. PATENT DOCUMENTS 2,721,591 A * 10/1955 Criswell ..... B25B 15/00 475/270
4,448,098 A * 5/1984 Totsu ..... B25B 15/04 81/467
(Continued)

FOREIGN PATENT DOCUMENTS

CN 101890688 A * 11/2010
CN 202462319 U 10/2012
(Continued)

*Primary Examiner* — Bryan R Muller
(74) *Attorney, Agent, or Firm* — Marsh Fischmann & Breyfogle LLP; Jonathon A. Szumny

(57) ABSTRACT

The present invention provides a screwdriver which includes a shaft, a handle and a speed increasing mechanism, in which the speed increasing mechanism includes a central axle connected to the shaft and provided with a toothed part on its periphery, a first member is disposed in the interior of the handle, at least one gear is connected to the first member, and a geared sleeve is sheathed outside the gear, in which the inner side of the geared sleeve has teeth on corresponding positions, engaging with the gear which is disposed at a side part of the central axle and is engaged with the toothed part of the periphery of the central axle. The present invention also includes a locking mechanism addressing the problem of torque being not high.

4 Claims, 4 Drawing Sheets

(51) Int. Cl.
*B25B 15/02* (2006.01)
*B25B 15/04* (2006.01)

(58) Field of Classification Search
USPC ..... 475/298–300, 331, 346, 347, 284, 311
See application file for complete search history.

(56) References Cited

U.S. PATENT DOCUMENTS

| | | | | |
|---|---|---|---|---|
| 4,920,828 | A * | 5/1990 | Kameda | B60K 17/3467 475/159 |
| 5,033,336 | A | 7/1991 | Chia-Tsai | |
| 6,899,653 | B2 * | 5/2005 | Murphy | B25B 17/00 475/317 |
| 7,361,117 | B2 * | 4/2008 | Yamazaki | F16H 48/10 475/249 |
| 7,987,745 | B2 * | 8/2011 | Gauthier | B25B 17/00 81/57 |
| 9,833,883 | B2 * | 12/2017 | Wang | B25B 15/04 |
| 2004/0092358 | A1 | 5/2004 | Murphy | |
| 2010/0294084 | A1 | 11/2010 | Gauthier et al. | |

FOREIGN PATENT DOCUMENTS

| | | | |
|---|---|---|---|
| CN | 203245784 | U | 10/2013 |
| CN | 203390828 | U | 1/2014 |

* cited by examiner

SCREWDRIVER

FIELD OF THE INVENTION

The present invention relates to a tool for screwing a screw and, more particularly, to a screwdriver.

DESCRIPTION OF THE PRIOR ART

Screws are tools used for screwing a screw to force it to be in position, including a shaft and a handle. Typically, the handle is manually turned in a full circle, and the shaft rotates in a full circle, until the screw is rotated to a predetermined position, which is very inefficient. Therefore, a speed-increased screwdriver appeared on the market, in which the handle is turned in a full circle, and the shaft may rotate in multiple full circles, thus providing efficiency of using the screwdriver. However, the torque of such screwdriver is not high.

Therefore, the market demand is a screwdriver which is efficient and solves the problem of the torque being not high, as well.

SUMMARY OF THE INVENTION

The object of the present invention is to provide a screwdriver with high efficiency for use, which adopts a speed increasing mechanism with simple structural design and is convenient for use.

Another object of the present invention is to provide a screwdriver with high efficiency for use, which adopts a locking mechanism to address the problem of the torque being not high with a common high-efficiency screwdriver.

In order to achieve the above object, the present invention provides a screwdriver comprising a shaft, a handle and a speed increasing mechanism, wherein the speed increasing mechanism comprises a central axle connected to the shaft and provided with a toothed part on the periphery of the central axle; a first member is disposed in the interior of the handle, at least one gear is connected to the first member, and a geared sleeve is externally sheathed the gear, wherein a inner side of the geared sleeve has teeth on corresponding positions, engaging with the gear which is disposed at a side part of the central axle and is engaged with a toothed part of the periphery of the central axle.

The screwdriver of the present invention further comprises a locking mechanism which comprises a second member rotatable along with the first member and a trigger switch connected to the second member, wherein a inner wall of a front portion of the second member has teeth matching with the toothed part of the periphery of the central axle; when the trigger switch is pushed to a first position, the teeth on the inner wall of the front portion of the second member do not contact the toothed part of the periphery of the central axle; when the trigger switch is pushed to a second position, the teeth on the inner wall of the second member are engaged with the toothed part of the periphery of the central axle.

The screwdriver of the present invention further comprises a ratchet arrangement provided between the tail portion of the shaft and the speed increasing mechanism, and the ratchet arrangement comprises a pawl base symmetrically arranged with two partially rotatable pawls: a first pawl and a second pawl along both sides of the central axle, and a member for controlling the position of the first pawl and the second pawl; the member has thereon two stopping blocks: a first stopping block and a second stopping block at the outside of the first pawl and the second pawl respectively for pushing the first pawl and the second pawl respectively; a pawl sleeve is arranged outside the first and second pawls and the first and second stopping blocks, a inner wall of the pawl sleeve has annularly distributed inner pawl teeth, and the pawl sleeve is able to engage with the teeth on the first pawl and the second pawl.

A further description will be made as to the conception, detailed structure, and expected technical effects of the present invention with reference to the accompanying drawings to make the objects, features, and advantages of the present invention fully understandable.

DETAILED DESCRIPTION OF THE PREFERRED EMBODIMENTS

Figure 1:
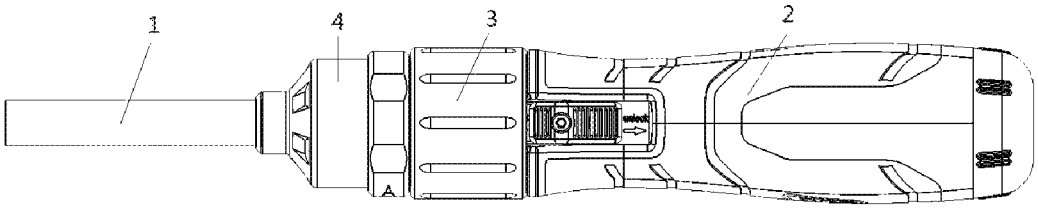
FIG. 1 is a top view of a preferred embodiment of the present invention.
Figure 2:
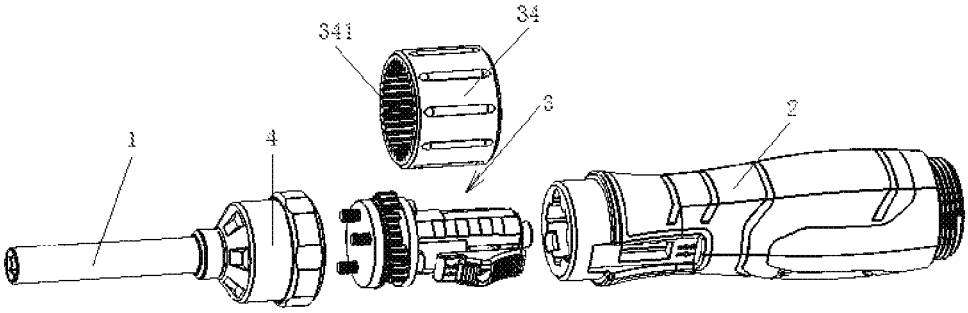
FIG. 2 is a perspective exploded view of a preferred embodiment of the present invention.

As shown in FIGS. 1 and 2, the screwdriver of the present invention includes a shaft 1, a handle 2 and a speed increasing mechanism 3. The handle 2 connects the speed increasing mechanism 3, and the handle 2 rotates and rotates in relation to the speed increasing mechanism 3 fixedly connected to the shaft 1 and being rotatable in conjunction with the shaft 1, so as to achieve the object of using.

Figure 4:
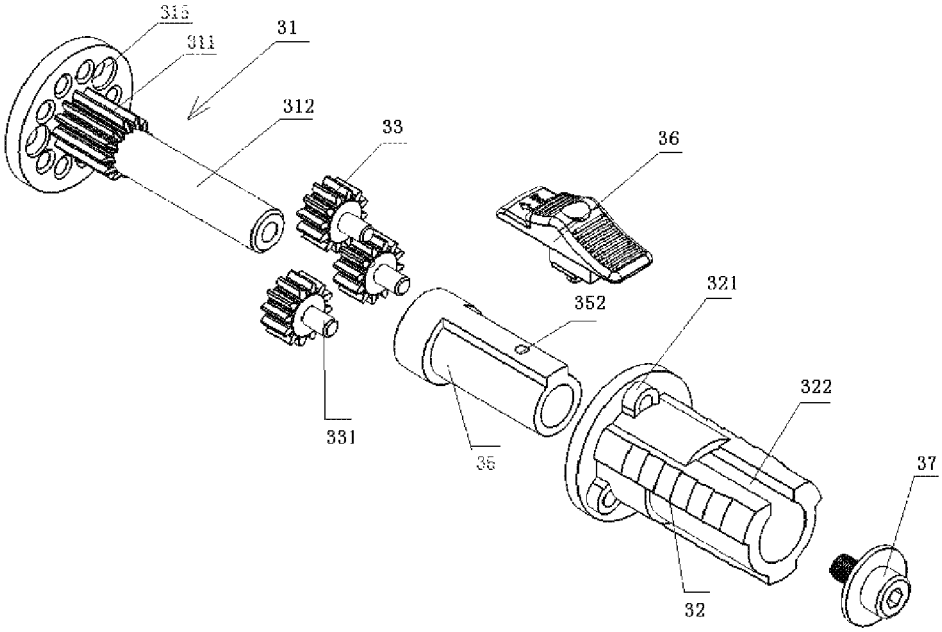
FIG. 4 is a perspective exploded view of a speed increasing mechanism of a preferred embodiment of the present invention.
Figure 5:
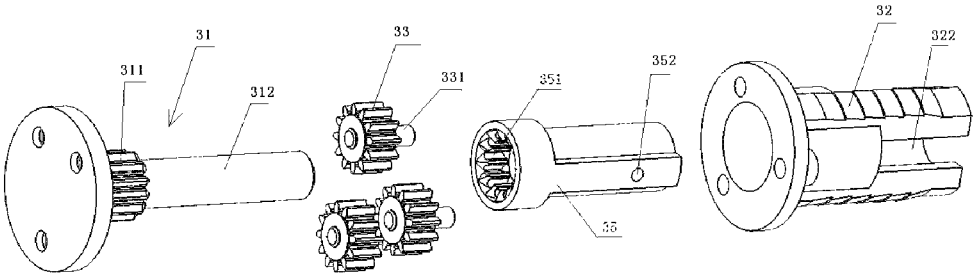
FIG. 5 is a perspective exploded view of a speed increasing mechanism of a preferred embodiment of the present invention from another angle of view.
Figure 6:
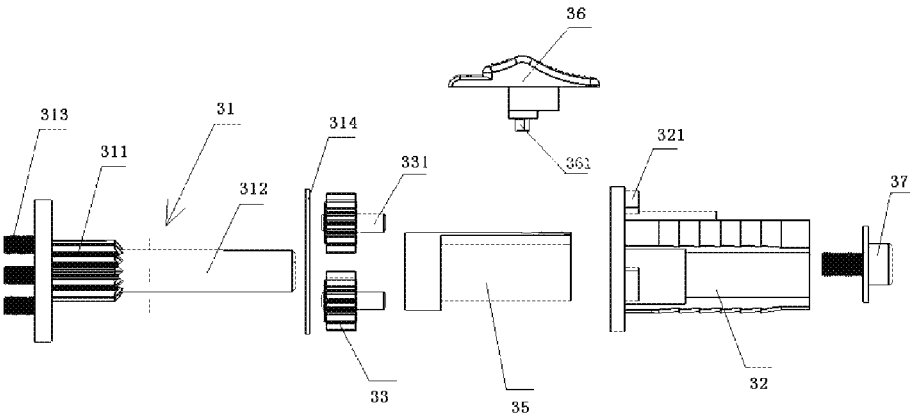
FIG. 6 is an exploded side view of a speed increasing mechanism of a preferred embodiment of the present invention.

As shown in FIGS. 4, 5 and 6, speed increasing mechanism 3 includes a central axle 31 connected to the shaft and provided with a toothed part 311 on its periphery, a first member 32 disposed in the interior of the handle, at least one gear 33 connected to the first member, and the gear 33 is disposed at a side part of the central axle and matches with toothed part 311 of the periphery of the central axle 31, and they can engage with each other. The speed increasing mechanism further includes a geared sleeve 34 sheathed outside the gear 33, in which the inner side of the geared sleeve 34 has teeth on corresponding positions, engaged with the gear 33.

Specifically, the central axle is disposed in the central position of the screwdriver, in the present invention, the screwdriver has three identical gears 33 respectively provided with equal distance therebetween on the periphery of the central axle 31 and engaged with the toothed part 311 of the periphery thereof. The three gears are all engaged with the inner teeth of the geared sleeve.

In use, the shaft engages with the target screw desired to be rotated, and is fixed in relation thereto. When the handle 2 and the geared sleeve 34 rotate in opposite directions, the handle 2 actuates the first member 32 to turn and the first member 32 drives the gear 33 to rotate and the gear 33 drives the central axle 31 provided with the toothed part 311 of the periphery thereof to rotate, so as to drive the shaft 1 to rotate to achieve the object of using speed increasing.

In order to address the problem of the torque being not high after speed increasing, the present invention also provides a designed locking mechanism including a second member 35 rotatable along with the first member and a trigger switch 36 connected to the second member 35, in which the inner wall of the front portion of the second member has teeth 351 matching with the toothed part 311 of the periphery of the central axle 31.

When the trigger switch 36 is pushed backward, i.e. which is in a first position, the teeth 351 on the inner wall of the front portion of the second member do not contact the toothed part of the periphery of the central axle 31, and the speed increasing mechanism moves normally as above described.

When the trigger switch 36 is pushed forward, i.e. which is in a second position, the inner sleeve is pushed forward, the teeth 351 on the inner wall of the front portion of the inner sleeve are engaged the toothed part of the periphery of the central axle 31, such that, in use, the torque applied by the handle can be directly transferred to the shaft and the torque can be increased.

In particular, the longitudinal cross-section of the central axle 31 is substantially T-shaped. The first end of the central axle and the shaft has a portion extending outward, i.e. the head portion of the T-shape, which is provided with at least one screw 313 at the portion extending outward and is fixedly connected to the tail portion of the shaft, so that the shaft is rotatable along with the rotation of the central axle. Here other method of connection may also be used, or the shaft can be integrated with the central axle.

The gear 33 is disposed in the position adjacent the outward extending portion of the central axle. A washer 314 is also provided between the gear 33 and the outward extending portion of the central axle 31, and the outward extending portion of the central axle is also arranged with a plurality of recesses being able to contain a plurality of rollers respectively, so that the rotation is smoother. The longitudinal width of the toothed part 311 of the periphery of the central axle 31 is greater than the longitudinal width of the gear 33, so the toothed part 311 of the periphery of the central axle 31 continues to extend a distance backward after passing through the gear 33. The central axle 31 also has a second portion 312, outward of the toothed part thereof, a non-toothed surface, which may be a smooth surface.

Each gear 33 has a backward extending axle 331 connected to the first member 32 which, in this embodiment, is an axle sleeve having a containing cavity 321 in its front portion for containing the axle 331 of the gear 33, so that the gear 33 is actuated to rotate when the axle sleeve rotates.

The second member 35 of the locking mechanism is an inner sleeve provided in the interior of the axle sleeve, being able to move forward and backward in relation to the axle sleeve. The inner sleeve is a cylinder, and the trigger switch 36 has a downward extending portion 361 passing through the handle 2 and the axle sleeve to fixedly connect to the inner sleeve 35, and the forward and backward movement of the inner sleeve is controlled by pushing the trigger switch 36 forward and backward.

A raised portion is longitudinally arranged on the cylindrical outside of the inner sleeve, and is provided with a hole 352 thereon. The downward extending portion of the trigger switch 36 is a cylindrical protrusion being able to extend into the hole so as to actuate the inner sleeve to move forward and backward. There is an opening 322 on the position corresponding to the trigger switch on the axle sleeve, so as not to interfere with the forward and backward movement of the extending portion of the trigger switch 36 and the inner sleeve.

The present invention also has a third member 37 arranged at the tail portion of the second member, which has a thread extending forward and being secured with the inner thread of the tail portion of the central axle, to longitudinally fix the central axle and the second member together.

As show in FIG. 1 and FIG. 7-12, the screwdriver of the present invention also includes a ratchet arrangement 4 provided between the tail portion of the shaft and the speed increasing mechanism, the ratchet arrangement 4 comprises a pawl base 41 symmetrically arranged with two partially rotatable pawls: a first pawl 411 and a second pawl 412 along both sides of the central axle, and a member 42 for controlling the positional state of the two pawls. The member 42 has thereon two stopping blocks: a first stopping block 421 and a second stopping block 422 corresponding to the two pawls 411, 412 respectively. A pawl sleeve 7 is arranged outside the pawls and the stopping blocks. The inner wall of the pawl sleeve 7 has annularly distributed inner pawl teeth, and the pawl sleeve is provided sheathed on the pawls and the inner pawl teeth thereof are engaged with the teeth on the two pawls 411, 412. A positioning device 8 connecting the member 42 is also arranged outside the pawl sleeve, and can also be integrally connected to the member 42. The positioning device 8 is specifically a rotating sleeve, being an annular sleeve provided sheathed the outside of the pawl sleeve. It is shown as in FIGS. 7 and 8 when the positioning device is in the middle position.

Figure 9:
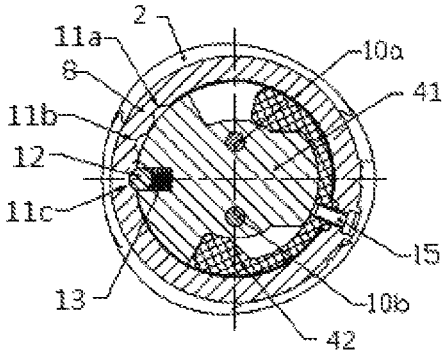
FIG. 9 is a sectional view of a ratchet arrangement in FIG. 3, taken along line B-B, in which the positioning device rotates clockwise.
Figure 10:
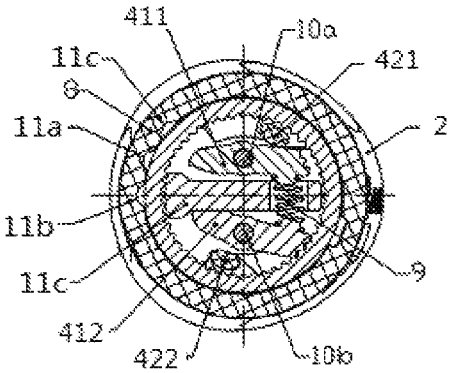
FIG. 10 is a sectional view of a ratchet arrangement in FIG. 3, taken along line C-C, in which the positioning device rotates clockwise.
Figure 11:
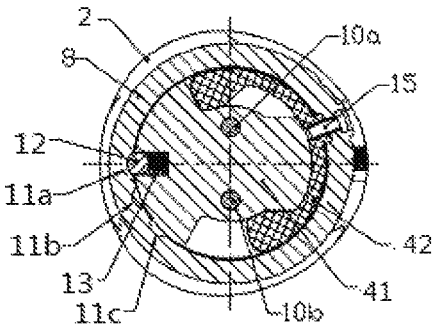
FIG. 11 is a sectional view of a ratchet arrangement in FIG. 3, taken along line B-B, in which the positioning device rotates counterclockwise.
Figure 12:
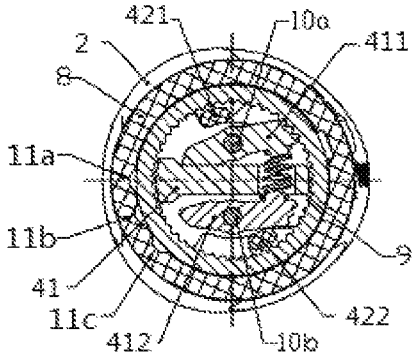
FIG. 12 is a sectional view of a ratchet arrangement in FIG. 3, taken along line C-C, in which the positioning device rotates counterclockwise.

When the positioning device 8 is rotated, the member 42 moves along with it, and the two stopping blocks 421, 422 on the member 42 also move along therewith. As shown in FIGS. 9 and 10, when the rotating sleeve 8 is turned clockwise, the first stopping block 421 squeezes the first pawl 411 to detach it from the inner pawl teeth of the pawl sleeve, and the other pawl 412 continues to engage with the inner pawl teeth of the pawl sleeve 7. At this time, turning the handle counterclockwise can transfer the torque from the handle to the shaft through the pawl base, the first pawl engaged with the pawl sleeve 7 and the pawl sleeve. When the handle is turned clockwise the second pawl engaged with the pawl sleeve can be taken by the pawl base to slide over the inner pawl teeth without transferring torque to the shaft, and the handle is turned around. As shown in FIGS. 11 and 12, when the rotating sleeve 8 is rotated counterclockwise, the second stopping block 422 squeezes the second pawl 421 to detach it from the inner pawl teeth of the pawl sleeve, and the other pawl 411 continues to engage with the inner pawl teeth of the pawl sleeve 7. At this time, turning the handle clockwise can transfer the torque from the handle to the shaft through the pawl base, the first pawl engaged with the pawl sleeve 7 and the pawl sleeve. When the handle is turned counterclockwise the first pawl engaged with the pawl sleeve can be taken by the pawl base to slide over the inner pawl teeth without transferring torque to the shaft, and the handle is turned around. As the rotating sleeve can be circumferentially positioned on the handle, no matter which position in the figure the rotating sleeve is rotated to, it can be maintained in that position through being positioned.

Further, an elastic member 9 for making the two pawls 411, 412 open to lean onto the pawl sleeve is supported between the two pawls, and the two stopping blocks 421, 422 on the member 42 are positioned respectively outside the corresponding pawl, thereby ensuring that the pawls are engaged with the pawl sleeve. The two pawls 411, 412 are connected to the pawl base through pins 10*a* and 10*b* respectively, thereby ensuring that the pawls can swing swiftly and that the pawl possesses sufficient capacity for transferring torque as well in the same time.

Figure 7:
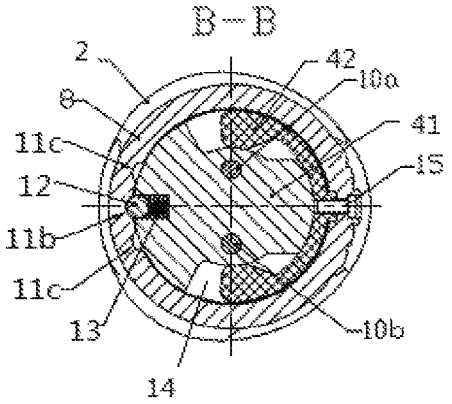
FIG. 7 is a sectional view of a ratchet arrangement in FIG. 3, taken along line B-B, in which the positioning device is in the middle position.
Figure 8:
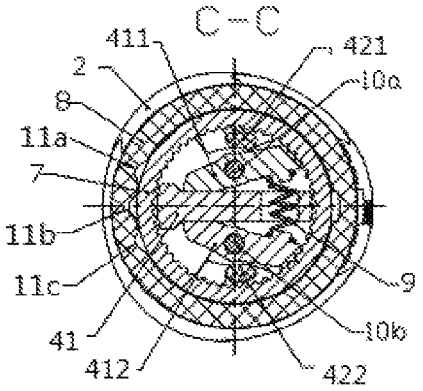
FIG. 8 is a sectional view of a ratchet arrangement in FIG. 3, taken along line C-C, in which the positioning device is in the middle position.

As shown in FIGS. 7-12, the inner wall of the rotating sleeve has three positioning recesses 11*a*, 11*b*, 11*c*, and the pawl base 41 is arranged thereon with a positioning ball 12 which is supported in a positioning recess by an elastic member 13, so as to actualize positioning of the rotating sleeve 8 on the handle. According to the structure, when the rotating sleeve 8 is in the states as shown in FIGS. 7 and 8, the positioning ball 12 is in the positioning recess 11*b* in the middle position on the rotating sleeve 8, where the two pawls are in the state as shown in FIG. 8. When the rotating sleeve 8 is in the states as shown in FIGS. 9 and 10, the positioning ball is in the positioning recess 11*c* in the lower side position of the rotating sleeve, where the two pawls are in the state as shown in FIG. 10. When the rotating sleeve 8 is in the states as shown in FIGS. 11 and 12, the positioning ball is in the positioning recess 11*a* in the upper side position of the rotating sleeve, where the two pawls are in the state as shown in FIG. 12.

Figure 3:
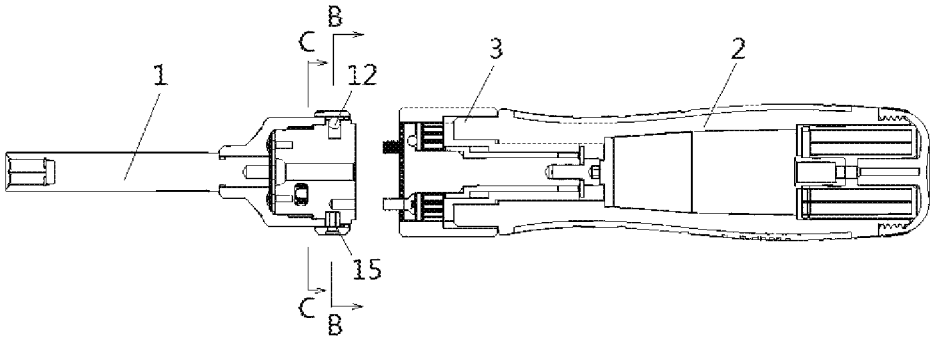
FIG. 3 is a transverse sectional view of a preferred embodiment of the present invention.

As shown in FIGS. 3 and 7, the pawl base has a recess 14, in which the member 42 is located, and the rotating sleeve 8 and the member 42 are connected through a fastener (such as a screw) therebetween, thereby realizing actuating the member 42 by the rotating sleeve, and at the same time also realizing constraining of the rotating sleeve by limiting the member 42 in the recess 14 unable to move axially, that is, forbidding the rotating sleeve to detach from the working position through a fastener.

The invention has been exemplified above with reference to specific embodiments. However, it should be understood that a multitude of modifications and varieties can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A screwdriver, comprising a shaft, a handle and a speed increasing mechanism, wherein the speed increasing mechanism comprises a central axle connected to the shaft and provided with toothed part on the periphery of the central axle; a first member is disposed in the interior of the handle, at least one gear is connected to the first member, and a geared sleeve is sheathed outside the at least one gear; wherein an inner side of the geared sleeve has teeth on corresponding positions, engaging with the at least one gear which is disposed at a side part of the central axle and is engaged with a toothed part of the periphery of the central axle;

further comprising a locking mechanism which comprises a second member rotatable along with the first member and a trigger switch connected to the second member, wherein an inner wall of a front portion of the second member, near the toothed part of the central axle, has teeth configured for engaging the toothed part of the periphery of the central axle; wherein when the trigger switch is pushed to a first position, the teeth on the inner wall of the front portion near the toothed part of the second member do not contact the toothed part of the periphery of the central axle; wherein when the trigger switch is pushed to a second position, the teeth on the inner wall of the second member are engaged with the toothed part of the periphery of the central axle;

wherein the second member is provided in the interior of the first member, being able to move forward and backward in relation to the first member, wherein the second member is a cylindrical inner sleeve, wherein an outside of the cylindrical inner sleeve includes a raised portion that is longitudinally arranged thereon, and wherein a hole is provided on a portion of the raised portion spaced longitudinally from the front portion having said teeth;

wherein there is an opening on a position corresponding to the trigger switch on the first member; the trigger switch has an extending portion passing through the handle and the opening of the first member and extending into the hole to fixedly connect to the second member; and the forward and backward movement of the second member is controlled by pushing the trigger switch forward and backward.

2. The screwdriver according to claim 1, wherein the number of the at least one gear is three, and the three gears are identical, respectively provided with equal distance there between on the periphery of the central axle and engaged with the toothed part.

3. The screwdriver according to claim 1, wherein a longitudinal width of the toothed part of the periphery of the central axle is greater than a longitudinal width of the at least one gear, and the central axle also has a portion other than the toothed part.

4. The screwdriver according to claim 1, wherein each gear has an axle extending toward the handle connected to the first member, and a front portion of the first member near the shaft has a containing cavity for containing the axle of the at least one gear.

* * * * *